United States Patent [19]

Muller

[11] 4,180,183

[45] Dec. 25, 1979

[54] TRAP DOOR FOR VENDING MACHINE

[76] Inventor: Alois Muller, 138 Elvaston Dr., Toronto, Canada

[21] Appl. No.: 894,740

[22] Filed: Apr. 10, 1978

[51] Int. Cl.[2] ..... B65H 3/30; E06B 7/00

[52] U.S. Cl. ..... 221/194; 49/68; 49/94; 109/68

[58] Field of Search ..... 221/67, 194, 195, 196, 221/12; 49/68, 94, 110; 109/19, 68; 232/43.1; 222/446

[56] References Cited

U.S. PATENT DOCUMENTS

| | | | |
|---|---|---|---|
| 3,174,646 | 3/1965 | Johnson | 221/129 |
| 3,269,595 | 8/1966 | Krakauer et al. | 221/195 X |
| 4,094,440 | 6/1978 | Lotspeich | 221/12 |

FOREIGN PATENT DOCUMENTS

| | | | |
|---|---|---|---|
| 811540 | 4/1969 | Canada | 221/67 |

*Primary Examiner*—Francis J. Bartuska

[57] ABSTRACT

An article vending machine, said machine having an article delivery chute, and an article delivery opening at the lower end of such shute, and a door for closing such opening, in which the improvement comprises a chute closure operable to close the chute and being moveable between chute closing and chute opening positions, and having linkage extending between the door and the chute closure whereby opening of the door automatically procures movement of the chute closure.

5 Claims, 6 Drawing Figures

TRAP DOOR FOR VENDING MACHINE

The invention relates to vending machines for vending articles of a thin rectangular shape, such as booklets of postage stamps and the like, although it is not exclusively confined thereto.

Vending machines for thin sheet articles are disclosed in U.S. Pat. No. 2,937,785. In such prior art vending machines, the articles are of rectangular shape and are thus stacked alternatively across one another. The cross stacked articles are supported in vertical columns, by means of vertical magazines or storage walls. At the bottom of such magazines, two pairs of flaps are provided, interlocked by an operating mechanism. One pair of flaps is held in a horizontal, article supporting position while the other pair of flaps is operated to drop downwardly thereby permitting an article supported thereon to drop down into a slide or chute.

This principle of operation has been found to be highly reliable and satisfactory and has given many years of trouble free service in the past. An opening at the front of the machine is provided, into which the article is delivered, so that it may be received by a purchaser.

A simple form of hinged trap door is located at the front of the machine to render the article opening weather tight. This trap door must be raised to reach inside the opening and retrieve an article in the chute. However, it is not completely effective to prevent the insertion of an implement such as a piece of wire. As in all vending machines, tampering with the machines, attempted pilferage and the like is always a problem. Frequently, it is found that someone has attempted to force an implement such as a piece of wire through the delivery opening into the machine, so as to dislodge one or more articles. While such attempts are not often successful, they frequently damage the mechanism of the machine, and cause serious servicing problems. At the very least, such attempts can lead to blockage of the machine so that it will not function to deliver articles to a purchaser.

It is therefore desirable to provide a modified form of construction in which, in addition to the outer trap door, there is an inner closure, automatically operated by opening of the outer door, which effectively prevents the insertion of an implement.

The inner closure is spaced inwardly from the outer door so as to allow an article purchased in a regular manner to rest between them. Thus when the purchaser raises the outer door this automatically closes the inner closure. The article can then be retrieved by the purchaser.

However if a thief attempts to insert an implement he must first of all open the outer trap door to do so. The act of opening the outer trap door automatically closes the inner closure, and thus prevents the insertion of an implement more than a relatively short distance i.e. corresponding to the length of an article in most cases.

The invention therefore seeks to provide, in an article vending machine, said machine having an article delivery chute, and an article delivery opening at the lower end of such chute, and door means for closing said opening, the improvement comprising closing means operable to close said chute, and being moveable between chute closing and chute opening position, and having linkage means extending between said outer door and said closure means whereby opening of said outer door automatically procures movement of said closure mean, whereby opening of said outer door automatically procures movement of said closure means from said open to said closed position.

The invention further provides that there shall be a spacing between the outer doors and the closure means at least equal to the length of the article for which the machine is intended.

The invention further provides in an article vending machine of the type described, inner closure means hingedly mounted for swinging between a vertical position, corresponding to the open position of the chute and a rearwardly angled closed position corresponding to the closed position of the chute, and including linkage means on the outer door interengaging with the closure means whereby to swing it from its vertical to its rearwardly angled position upon opening the outer door.

The invention further provides in an article vending machine of the type described, outer door means swingably mounted for swinging between a vertical closed position and a lever member fastened to said outer door means, and extending into engagement with said inner closure means whereby upon outward swinging of said outer door, said lever member swings inwardly and contacts said inner closure means, and forces the same to swing inwardly, whereby the outer door is swung outwardly said inward door is swung inwardly more or less in unison, and when said outer door is swung inwardly said inner closure swings outwardly, the door and the closure therefore swinging in unison in opposite directions to one another.

The invention also provides in an article vending machine of the type described, baffle means in said article delivery chute, said baffle means being located to intercept an implement inserted into said chute means, and deflect the same.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 1:
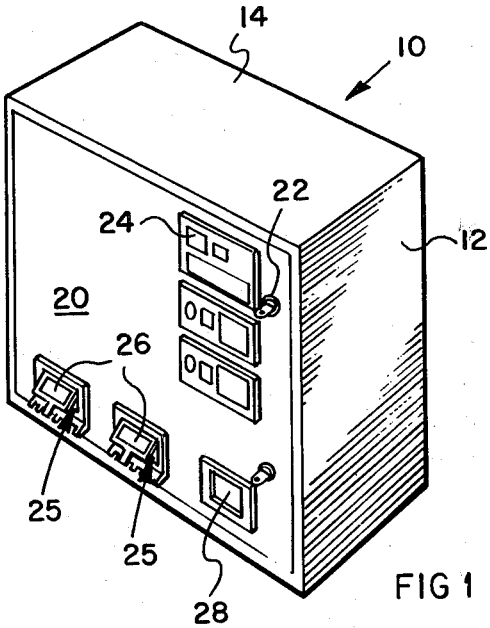
FIG. 1 is a perspective frontal illustration showing the vending machine according to the invention.
Figure 3:
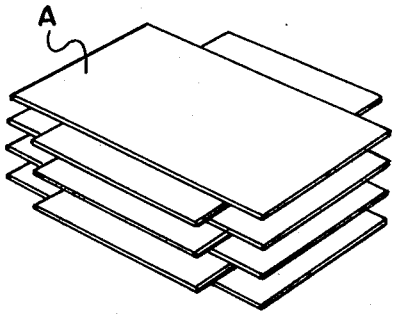
FIG. 3 is a perspective of a stack of articles.
Figure 2:
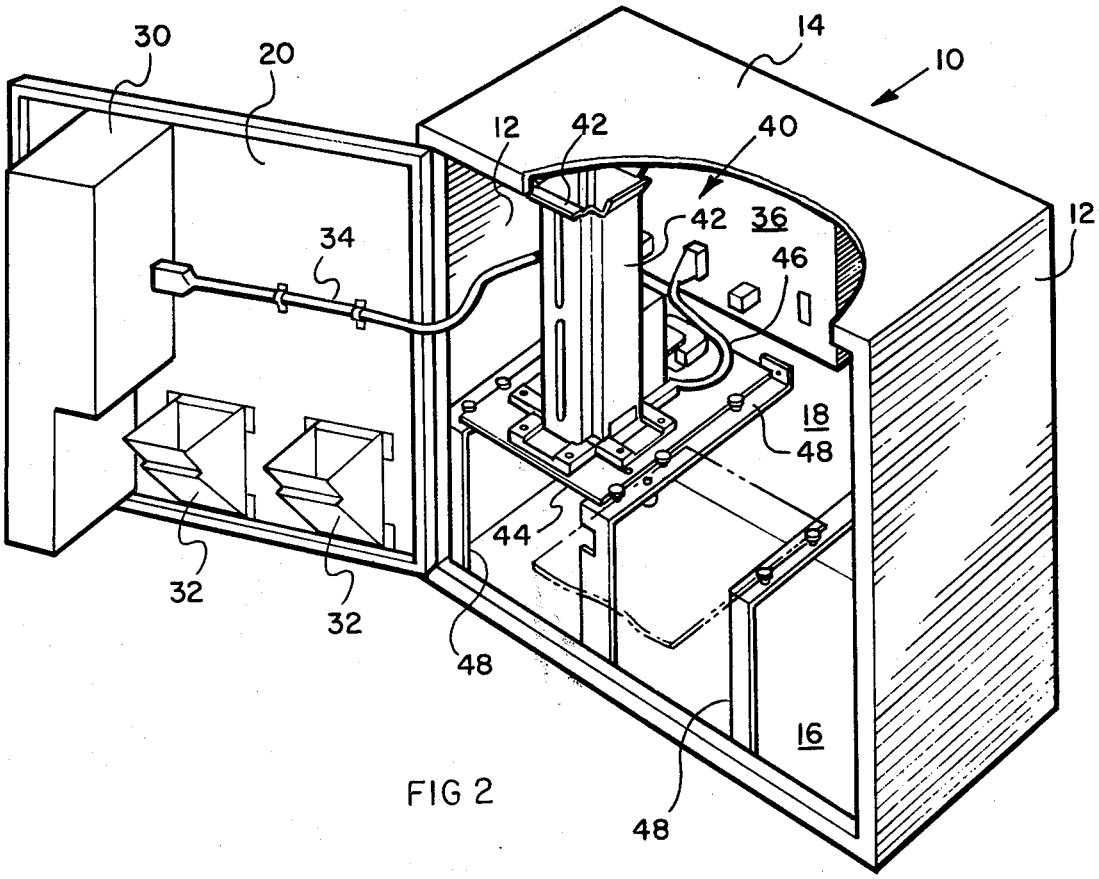
FIG. 2 is a similar view showing the front of the machine opened up.

Referring now to FIGS. 1 and 2 it will be seen that the vending machine according to the invention comprises a generally rectangular box like housing 10 having side walls 12 top walls 14, bottom wall 16, and rear wall 18.

The front door panel 20 is hinged to one of the side walls 12, and may be locked shut by means of a lock and key 22.

On the front face on the door panel 20 there is provided a coin slot 24, and article dispensing opening 25 and door 26, and a coin return and opening 28.

On the inner face the door panel 20, there is provided a coin rejector mechanism shown generally as 30, and two article delivery chute means 32.

The coin rejector mechanism 30 is not described in detail, and is of the type well known in the art. It is electrically operated and is connected by means of a cable 34 to a control box 36 mounted on real wall 18 of housing 10.

Control box 36 is of course provided with any suitable cable (not shown) whereby it may be plugged into a source of electrical power.

Within the housing 10 there are located, in this embodiment of the invention, two article dispensing units, one of which is indicated generally as 40 (the other being omitted for the sake of clarity). It will however be appreciated that such a further unit 40 would normally be incorporated.

The invention is not however restricted to a vending machine having two such article dispensing units 40. There could be a single unit or there could be multiples of such units depending on the particular application. The dispensing unit 40 performs two functions namely that of storing a sufficient quantity of articles, and also of dispensing or releasing the articles one by one as they are purchased.

In order to store the articles four generally channel shaped vertical wall members 42 are arranged to form an upstanding hopper or magazine like structure.

The wall members 42 are supported on a base plate 44 and an article release mechanism (not shown) is located below plate 44. It is operable to release articles one at a time from the stacks in the walls 42.

One type of mechanism is shown in U.S. Pat. No. 2,937,785.

Such mechanism is operated by any suitable electrical drive means 46 connected by cable 47 to the control box 36. Base plate 44 is itself supported on support frames 48 at a suitable elevation in the housing 10. The frames 48 are so arranged that when the door 20 is closed the two chutes 32 will fit beneath respective article dispensing units 40, and be in a position to catch articles dispensed therefrom.

Figure 5:
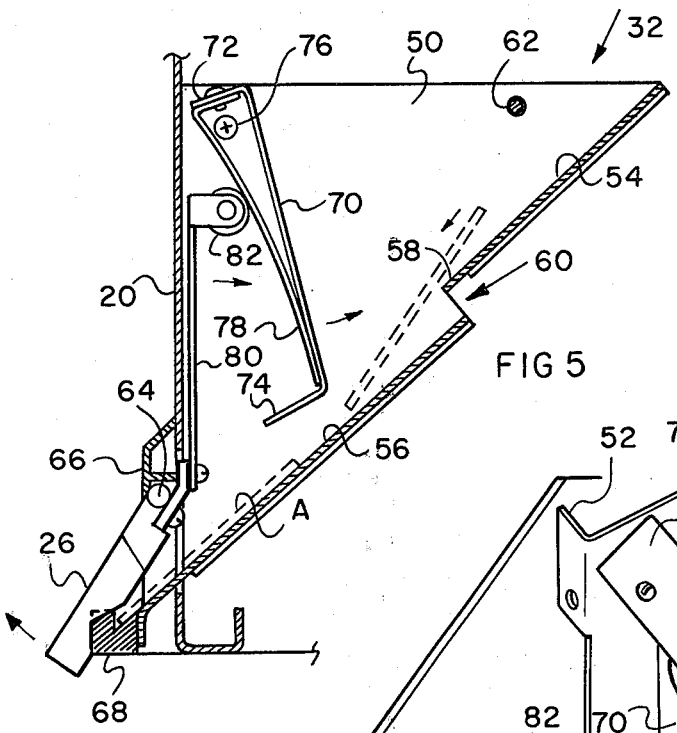
FIG. 5 is a section along 5—5 of FIG. 4.
Figure 4:
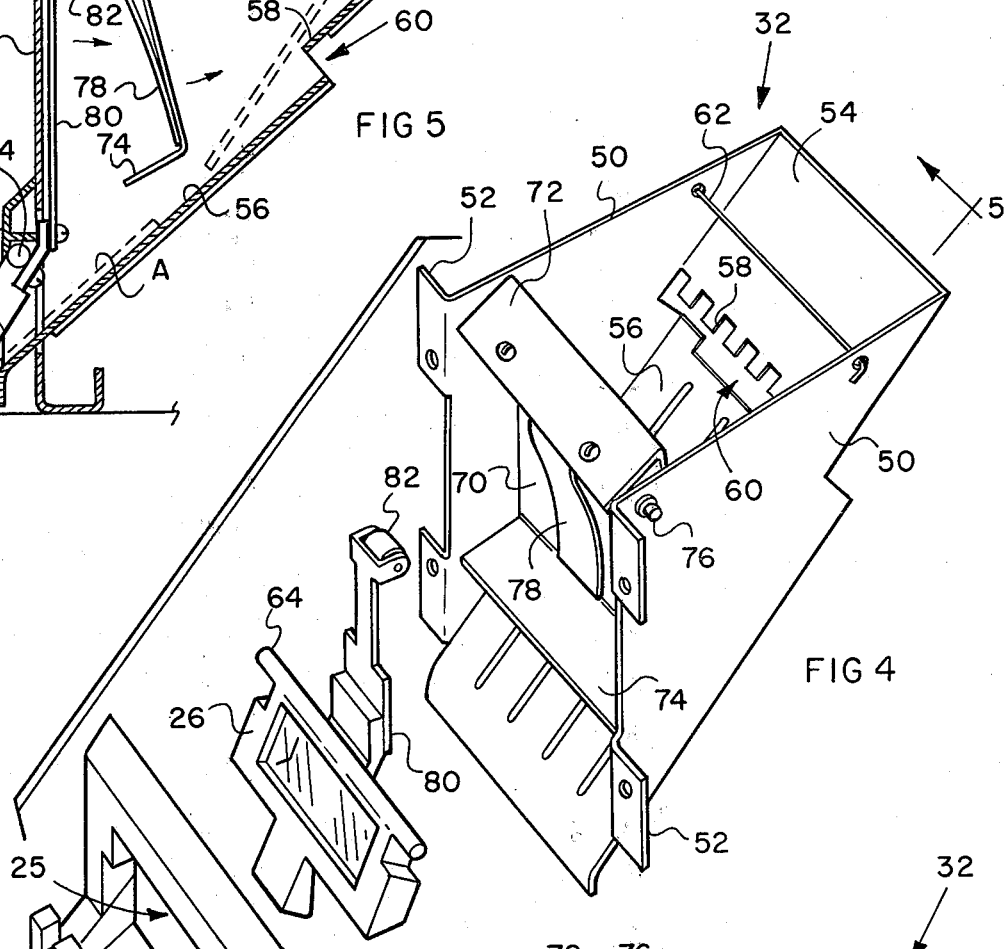
FIG. 4 is an exploded perspective illustration showing the article dispensing chute.
Figure 6:
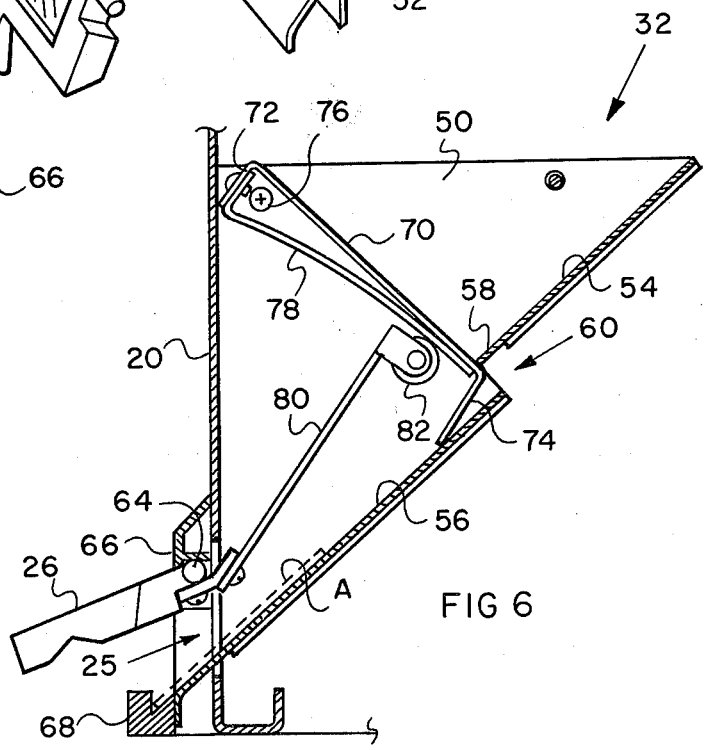
FIG. 6 is a section along 5—5 showing another position of the mechanism.

As best shown in FIGS. 4, 5 and 6 each of the chutes 32 comprises a pair of side walls 50, having outwardly bent attachment flanges 52 thereon, by means of which they may be bolted to the inward surface of the door 20 as shown in FIG. 2.

Each chute 32 further comprises an upper and lower slide portions 54 and 56, which are supported at an angle between the lower edges of respective side walls 50.

The lower edge of upper slide portion 54 is serrated as at 58, and is located spaced above the plane of the lower slide portion 56, thereby defining a false opening 60 therebetween.

A tipping rod 62 extends between the upper edges of the two side walls 50, in the path of an article falling into the chute 32, which functions to tip the article over and thus ensures a clean feeding of the article into the chute.

As mentioned above, on the exterior of door 20, i.e. on its outwardly facing surface, there is provided a door flap 26 closing the opening 25.

The door 26 is supported on hinge pins 64 extending out from either side, which are themselves received in a door frame casting 66. Casting 66 further defines a lower lip 68 the function of which is to catch an article indicated as A as it slides down the lower slide portion 56.

In order to prevent the insertion of a probe or other article (not shown) an inner chute closure member 70 is provided, formed of flat sheet metal, and having forwardly angled upper and lower walls 72 and 74. A generally transverse hinge rod 76 is provided, fastened below the upper wall 72, and extending through opposite side walls 50 of the chute.

The length of the closure panel 70 and the location of the rod 76 are selected so that, the closure 70 may be swung between a forward at rest position as shown in FIG. 4, and a rearwardly angled closure position as shown in FIG. 5.

When in the forward at rest position in the FIG. 4 an article A may pass along the surface of lower slide 56, through the clearance between slide 56 and the lower flange 74 of closure 70. When swung rearwardly as shown in FIG. 5 however the lower edge of closure panel 70 abutts against the serrations 58 of upper slide 54, and lower edge 74 touches the lower slide 56, thereby closing off the entire chute, and preventing insertion of a probe or other implement.

In order to procure the swinging action, a generally concavely curved ramp member 78 is provided on closure 70, fastened to the lower side of the upper edge 72 and extending in a downwardly and inwardly curving manner, until at its lower end, adjacent lower edge 74, it is lying more or less parallel to and in contact with the closure 70.

An operating lever arm 80, is fastened integrally with the door 26, in the article opening 25, and will swing in unison therewith. The upper end of the lever arm 80 is provided with a roller 82, which is located and arranged to ride on the ramp 78. The lever arm 80 is attached to the door 26 at a slight angle, so that when the door 26 is closed as shown in FIG. 4 the lever arm 80 extends upwardly inside the front door 20 more or less parallel thereto with the roller 82 extending away from the arm 80, and contacting the ramp 78.

When the door 26 is raised upwardly and outwardly as shown in FIG. 5, by a purchaser, or by someone attempting to tamper with the machine, the arm 80 swings forwardly and downwardly towards the interior of the chute. Such swinging causes the roller 82 to roll along the ramp 78, and cause inward and rearward swinging of the inner closure 70 as shown in FIG. 5 thereby closing off the chute.

It will however be noted that the dimensions of the system are such that the rearward swinging of the inner closure 70 will not obstruct the article A which has already been properly purchased, and has fallen against lip 68. It may thus be extracted readily by the purchaser without interference from the closure 70.

It will of course be appreciated that the function of the tipping rod 62 is to engage an article A as it falls downwardly from the storage mechanism, into the chute, and ensure that it tips over at an angle, so that it may fall cleanly and smoothly into the chute and slide down the slides 54 and 56, beneath the lower edge 74 of the closure 70 as shown in FIG. 4 and come to rest on lip 68.

In the event that someone should attempt to tamper with the machine, then if the door 26 is fully opened, the closure 70 and lower edge 74 completely obstruct access to the interior of the vending machine, and it will simply be impossible to insert any probe or other article.

If however such a tamperer should open the door 26 only part way, such that for example the closure 70 may not be fully shut, then in some circumstances it may be possible to insert a thin probe such as a piece of wire between slide 56 and lower edge 74. In this case however such a probe will be caught by the upper slide 54, and it will simply pass through the false opening 60 so that again, tampering with the actual contents of the vending machine is virtually impossible. In practice however, the arrangement of the ramp 78 and roller 82 are such that even a partial raising of the door 26 will procure complete closing of the closure 70, when the machine is properly set up.

The foregoing is a description of a preferred embodiment of the invention which is given here by way of example only. The invention is not to be taken as limited to any of the specific features as described, but comprehends all such variations thereof as come within the scope of the appended claims.

What is claimed:

1. A self-closing chute for use in an article vending machine of the type having article storage and dispensing means, and mechanism whereby an article may be dispensed and dropped downwardly under the influence of gravity, and comprising;

an article delivery chute located and arranged to catch a said article;

article opening means at the lower end of the chute, through which a said article may be retrieved;

moveable door means normally at least partially closing said article opening, and swingable relative thereto between an upwardly and outwardly open position, and a downwardly swung closed position;

chute closure means located inwardly with respect to said moveable means and swingably mounted, for movement between an inactive open position, and a rearwardly swung chute closing position, and, operating means connecting between said door means and said closure means whereby when said door means is swung forwardly, said chute closure means is swung rearwardly.

2. A self closing chute as claimed in claim 1 wherein said chute closure means comprises a panel member having upper and lower edges, and hinge means connected to its upper edge whereby said panel member may swing between a more or less vertical inactive position and a rearwardly swung chute closing position, and, linkage means connecting between said moveable means and said panel, whereby movement of said moveable means for movement in response to movement of said moveable means between its normal position, and its open position.

3. A self closing chute as claimed in claim 2 including a curved ramp member on said panel, said linkage means moveably engaging said ramp.

4. A self closing chute as claimed in claim 1 including at least two slide portions mounted at an angle, for downward sliding of an article along said chute, and wherein said slide portions are mounted in respective upper and lower locations, with the upper of said slide portion being in a different plane from the plane of the lower said slide portions, and including opening means adjacent the lower edge of said upper slide portion for entrapment of an implement inserted in said chute.

5. A self closing chute as claimed in claim 4 wherein said chute closure means comprises a panel member swingably mounted for swinging between a forward and rearward position, said panel member being dimensioned and arranged so that when in its rearwardly swung position, it engages said lower edge of said upper slide portion thereby closing off said chute against the insertion of an implement.

* * * * *